US007694891B2

(12) United States Patent
Sturman

(10) Patent No.: US 7,694,891 B2
(45) Date of Patent: Apr. 13, 2010

(54) FUEL INJECTOR WITH BOOSTED NEEDLE CLOSURE

(75) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 0 days.

(21) Appl. No.: 12/434,261

(22) Filed: May 1, 2009

(65) Prior Publication Data

US 2009/0212126 A1 Aug. 27, 2009

Related U.S. Application Data

(62) Division of application No. 11/872,537, filed on Oct. 15, 2007, now Pat. No. 7,568,632.

(60) Provisional application No. 60/852,515, filed on Oct. 17, 2006.

(51) Int. Cl.
*F02D 7/00* (2006.01)
*F02M 47/02* (2006.01)
*F02M 41/16* (2006.01)

(52) U.S. Cl. ..... 239/5; 239/88; 239/92; 239/96; 239/533.8

(58) Field of Classification Search ..... 239/5, 239/88–92, 96, 533.2–533.5, 533.8, 533.9, 239/585.1–585.5; 123/445–447
See application file for complete search history.

(56) References Cited

U.S. PATENT DOCUMENTS

| | | | |
|---|---|---|---|
| 4,402,456 | A | 9/1983 | Schneider |
| 4,418,867 | A | 12/1983 | Sisson |
| 4,494,696 | A | 1/1985 | Schneider |
| 4,538,576 | A | 9/1985 | Schneider |
| 5,460,329 | A | 10/1995 | Sturman |
| 5,479,901 | A | 1/1996 | Gibson et al. |
| 5,485,957 | A | 1/1996 | Sturman |
| 5,669,355 | A | 9/1997 | Gibson et al. |
| 5,682,858 | A | 11/1997 | Chen et al. |
| 5,687,693 | A | 11/1997 | Chen et al. |
| 5,697,342 | A | 12/1997 | Anderson et al. |

(Continued)

FOREIGN PATENT DOCUMENTS

| | | |
|---|---|---|
| EP | 1507082 | 2/2005 |

OTHER PUBLICATIONS

"International Search Report and Written Opinion of the International Searching Authority Dated Mar. 31, 2008", International Application No. PCT/US2007/022019.

*Primary Examiner*—Darren W Gorman
(74) *Attorney, Agent, or Firm*—Blakely Sokoloff Taylor & Zafman LLP

(57) ABSTRACT

Fuel injectors with boosted needle control providing controlled and rapid needle closure. Boost and drive pistons are provided for hydraulic actuation to controllably close the needle, with the boost piston reaching a mechanical stop before the needle reaches the closed position, with the drive piston alone providing adequate hydraulic force to hold the needle closed. In a preferred embodiment, fuel from the intensifier is coupled to the top of the boost and drive pistons to close the needle, and controllably coupled to the bottom of the boost and drive pistons to allow pressure in the needle chamber to open the needle. Apparatus for control of fuel pressure to the bottom of the boost and drive pistons is disclosed.

7 Claims, 5 Drawing Sheets

U.S. PATENT DOCUMENTS

| | | | |
|---|---|---|---|
| 5,697,372 | A | 12/1997 | Hughes |
| 5,720,261 | A | 2/1998 | Sturman et al. |
| 5,738,075 | A | 4/1998 | Chen et al. |
| 5,826,562 | A | 10/1998 | Chen et al. |
| 5,833,146 | A | 11/1998 | Hefler |
| 5,954,030 | A | 9/1999 | Sturman et al. |
| 5,970,956 | A | 10/1999 | Sturman |
| 6,012,644 | A | 1/2000 | Sturman et al. |
| 6,085,991 | A | 7/2000 | Sturman |
| 6,161,770 | A | 12/2000 | Sturman |
| 6,257,499 | B1 | 7/2001 | Sturman |
| 6,360,728 | B1 | 3/2002 | Sturman |
| 6,557,776 | B2 | 5/2003 | Carroll, III et al. |
| 2002/0017573 | A1 | 2/2002 | Sturman |
| 2005/0103310 | A1 | 5/2005 | Kern |
| 2005/0224599 | A1 | 10/2005 | Magel |
| 2006/0192028 | A1 | 8/2006 | Kiss |

FUEL INJECTOR WITH BOOSTED NEEDLE CLOSURE

CROSS-REFERENCE TO RELATED APPLICATION

This application is a divisional of U.S. patent application Ser. No. 11/872,537 filed Oct. 15, 2007 now U.S. Pat. No. 7,568,632 which claims the benefit of U.S. Provisional Patent Application No. 60/852,515 filed Oct. 17, 2006.

BACKGROUND OF THE INVENTION

1. Field of the Invention

The present invention relates to the field of fuel injectors.

2. Prior Art

Preferred embodiments of the present invention are directed toward fuel injectors for diesel engines, though the invention is not so limited. The performance of an engine such as a diesel engine, particularly with respect to emissions, is highly dependent on the performance of the fuel injector used. In general, the better atomization of the fuel by the injector nozzle, the lower the emissions will be, both in hydrocarbons and nitrous oxides. For this purpose, smaller injection orifices together with higher injection pressures through intensification are desired. However, it is still desired for the injector needle to rapidly close at the end of injection, as a slow closure as the intensification pressure drops will allow some injection with poor or no atomization, grossly increasing the hydrocarbon emissions. Consequently, techniques for direct needle control have recently been developed wherein closure of the needle is augmented by a fluid under pressure controllably acting on the needle to force the needle closed against substantial fuel pressures, thereby closing the needle before the fuel pressure drops sufficiently for a needle return spring to be able to close the needle.

Injection pressures as high as 3000 bar and even higher are now being considered. To rapidly close the needle at the end of injection at such pressures, a substantial force must be exerted on the needle. While the total needle motion may only be on the order of 0.010 inches, such a force causes the needle to close with a significant impact, which has been found to cause premature injector failure by the breaking off of the nozzle's tip, which in turn can lead to other damage of an engine. Accordingly, it is particularly important that rapid needle closure be achieved in injectors using high pressure injection without degradation of the nozzle, or at least without sufficient degradation of the nozzle during the useful life of the injector so as to provide any substantial likelihood of a nozzle tip breakage during that useful life.

DETAILED DESCRIPTION OF THE PREFERRED EMBODIMENTS

Figure 1:
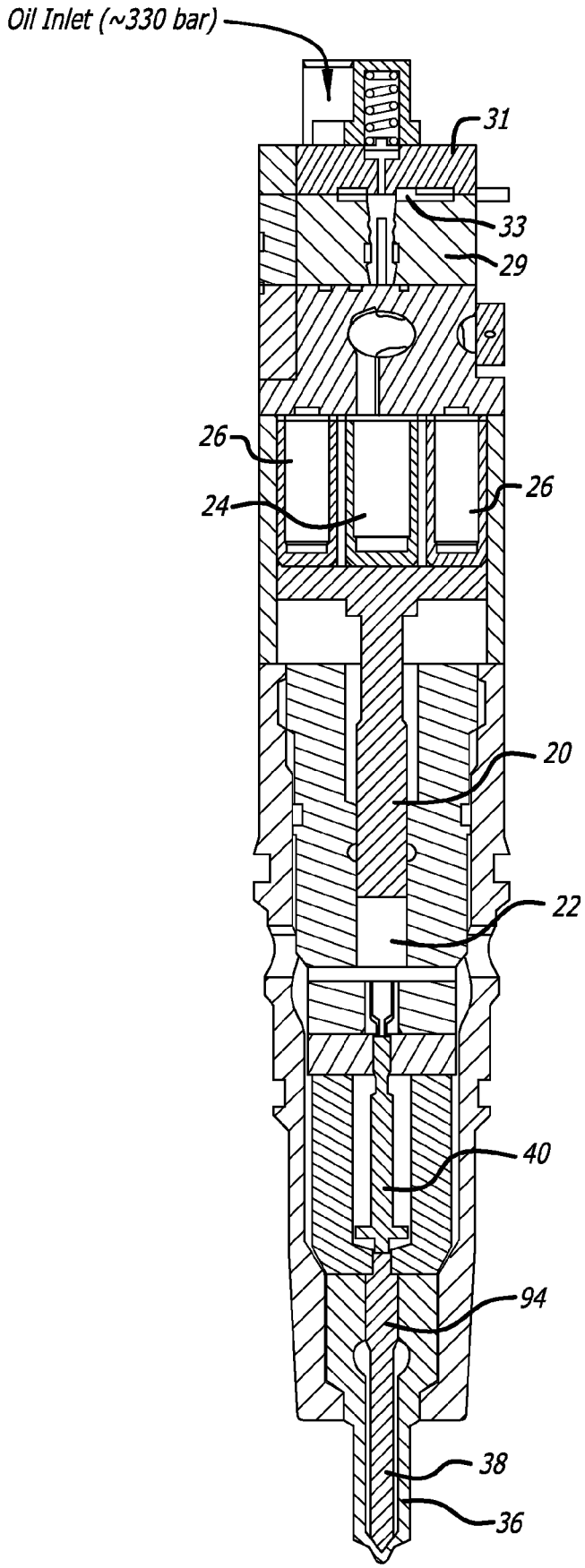
FIGS. 1 and 2 are cross-sections of an injector in accordance with the present invention.
Figure 2:
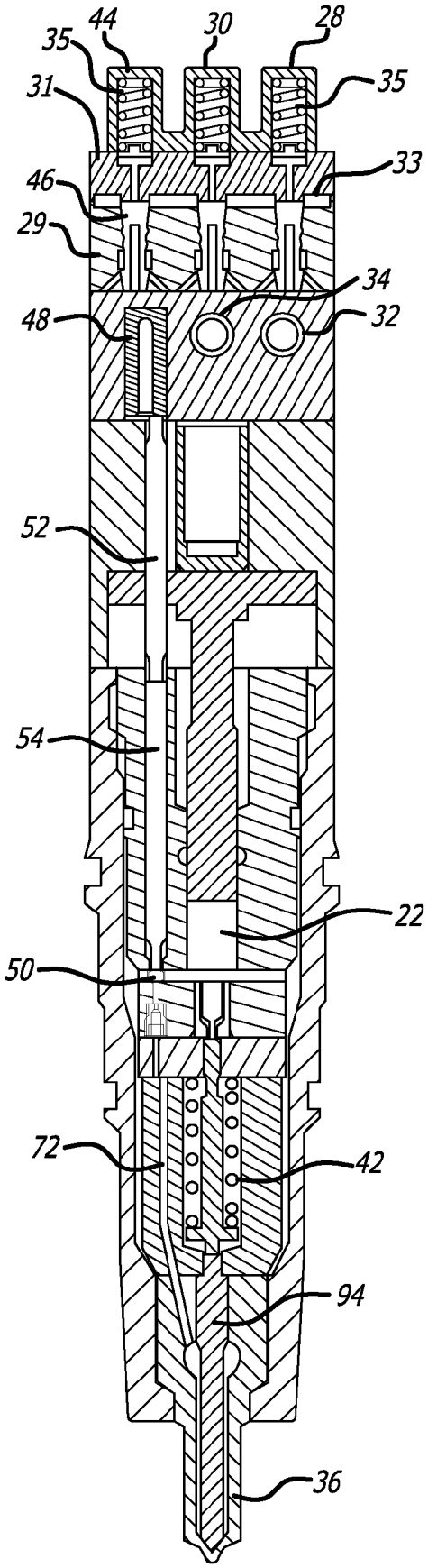

First referring to FIGS. 1 and 2, an intensifier type fuel injector in accordance with the present invention may be seen. The intensifier 20 intensifies fuel in chamber 22 as a result of downward force on the top of the intensifier by either intensifier piston 24 or intensifier pistons 26, or by the combination of intensifier pistons 24 and 26. For this purpose, two electrically controlled spool valves 28 and 30 may be individually controlled or controlled together to provide any one of three intensifications (assuming that the actuation pressure for the intensifiers pistons is constant), namely, the intensification obtained by pressurizing the center piston only, the intensification obtained by pressurizing the outer two pistons only, and the intensification obtained by pressurizing all three pistons. Obviously the piston areas determine the relative intensifications which may be selected by design, as desired. The control valves 28 and 30 are first stage control valves providing hydraulic control for the main valves 32 and 34, also spool valves, which control the flow of pressurized intensifier actuation fluid from the pressure source to the respective intensifier piston or pistons, or from there to a vent. Thus the intensifier of this embodiment may provide any of three separate intensification pressures as controlled by two two-stage valves, spool valves or otherwise.

In the preferred embodiment, the control valves 28, 30 and 44 are single coil, spring return spool valves sharing stationary magnetic members 29 and 31 entrapping printed circuit board 33 there between (FIG. 2). The printed circuit board is a one piece, multi-layer board having openings therein to accommodate the spools, and having multi-layer interconnected printed coils around each opening forming a winding, one for each control valve. The printed circuit board may be dedicated, one to an injector, or may extend in a direction perpendicular to the cross section shown and have the openings and coils replicated for multiple injectors in an engine, with or without additional control electronics on the circuit board between injectors. The spring returns are provided by springs 35, which may be strong enough to overcome the latching tendency of the spool valves so that after pulsing a coil with a high current pulse to actuate an actuator, a small holding current will be used thereafter until the spool is to be returned by the respective spring to its un-actuated position. Alternatively a spool may magnetically latch in the actuated position by a short, high current pulse, even against the contrary force of the return spring, and then be released on command by a lower current demagnetizing force.

Other parts of the injector visible in FIGS. 1 and 2 are the nozzle 36, the needle 38 and the needle drive pin 40, encouraged to the closed position by needle return spring 42 (see FIG. 2, not shown in FIG. 1). Also shown in FIG. 2 is a third electrically controlled valve 44 controlling a second stage three-way valve 46 to control pressure over a control piston 48, which in turn controls a three-way valve 50 through push rods 52 and 54.

The intensifier 20 is returned to the upper position after each injection event by the venting of the piston chamber(s) to a low pressure vent, with higher pressure fuel being provided through a check valve to chamber 22, forcing the intensifier 20 upward between injection events, though a return spring may also be used if desired.

Figure 3:
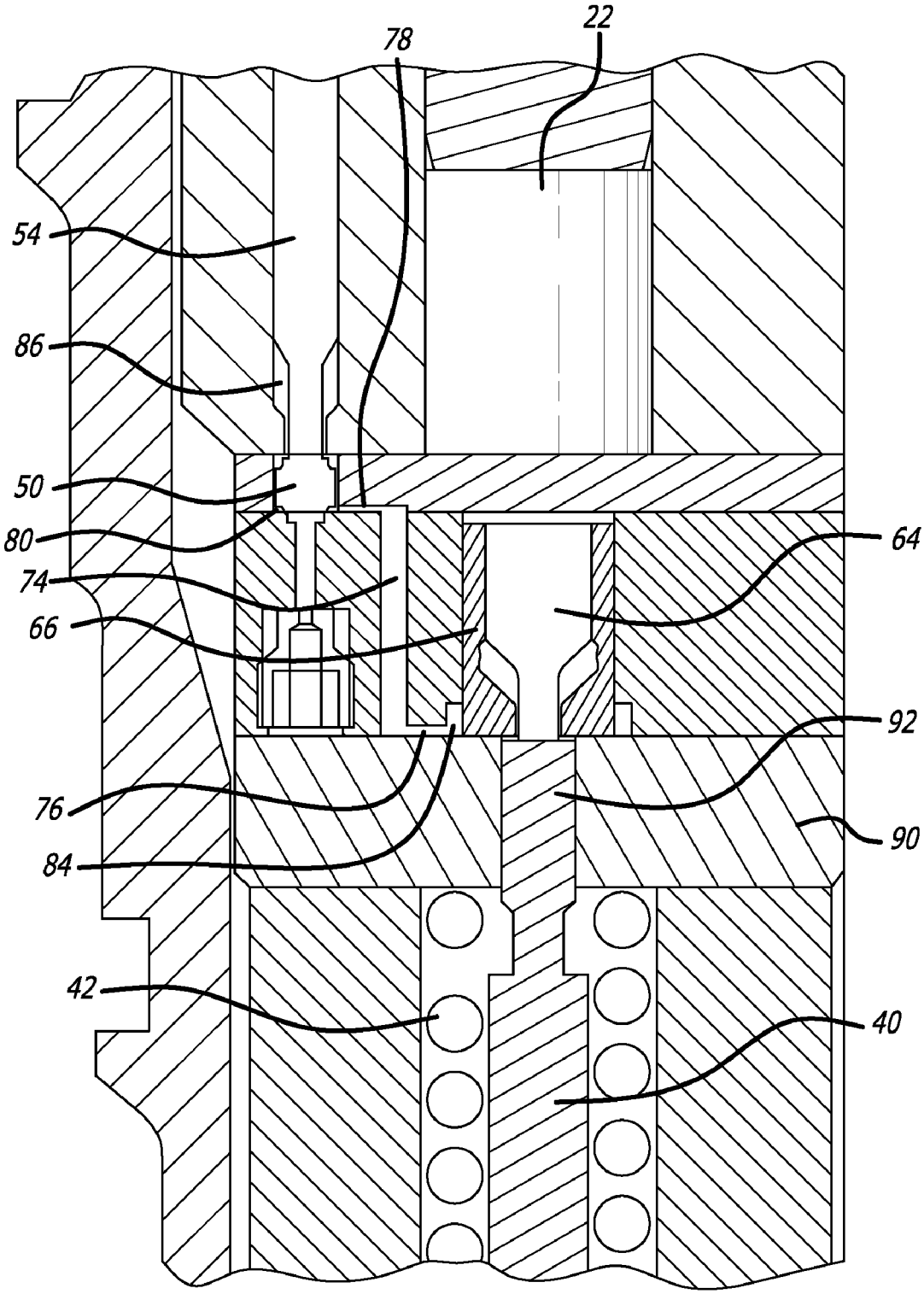
FIGS. 3 and 4 are local cross-sections of the injector of FIGS. 1 and 2 taken on an expanded scale, the cross-sections taken in part at different angles around the axis of the infector.
Figure 4:
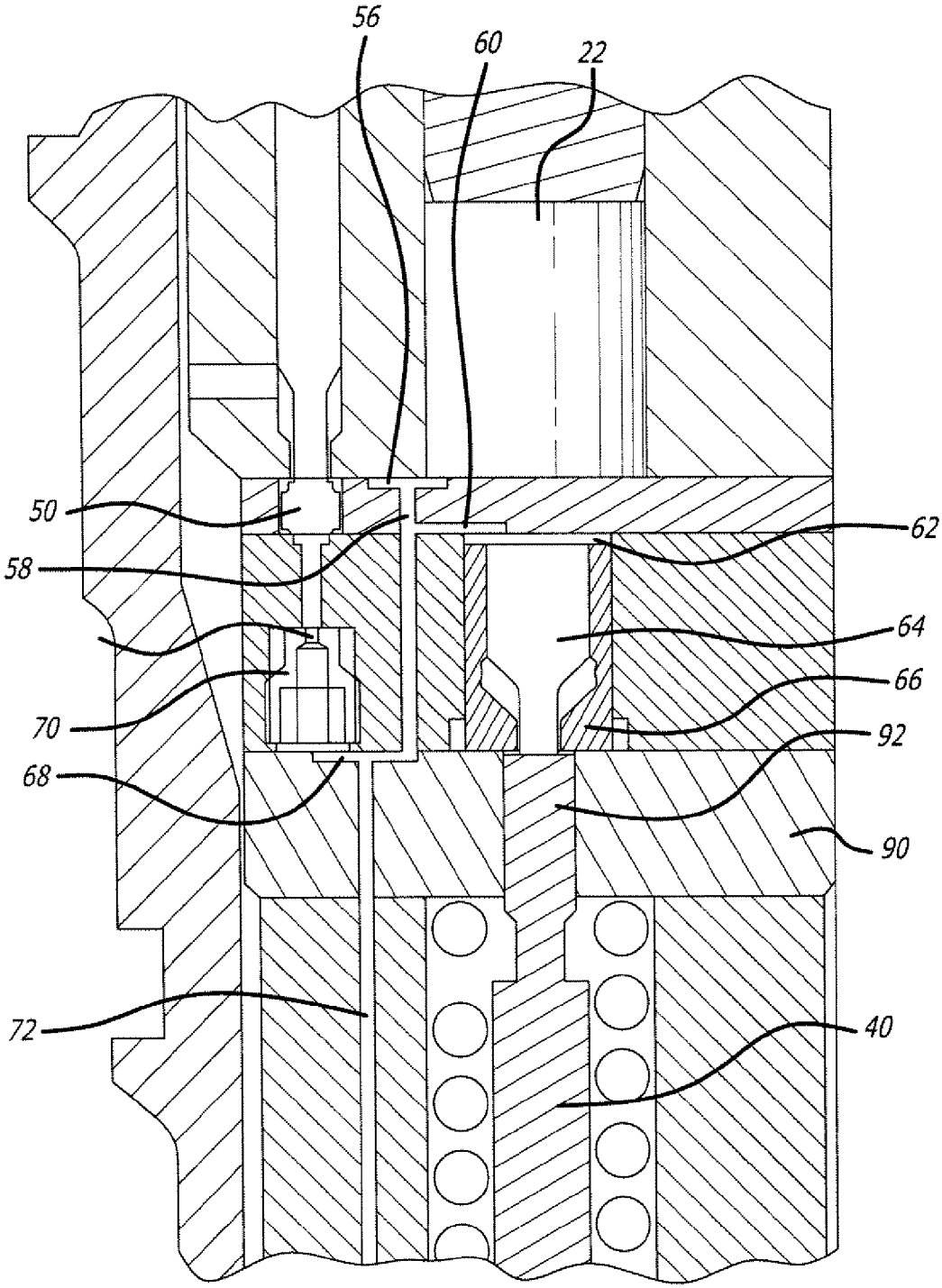

Now referring to FIGS. 3 and 4, cross-sections of part of the injector of FIGS. 1 and 2 taken on an expanded scale may be seen. Both of these Figures appear to show the same cross-section, though as shall subsequently be seen in greater detail, also show some conflicting porting. However it should be understood that that porting, in fact, is not conflicting in that it is positioned in part at two different angular positions around the axis of the injector. In particular, referring first specifically to FIG. 4, the high pressure intensified fuel chamber 22 is ported through ports 56, 58 and 60 to chamber 62 over a drive pin 64 within a boost piston 66. Port 58 is also coupled to port 68, coupled through orifice insert 70 to the bottom of three-way valve 50, and to port 72 coupled to the needle chamber within nozzle 36 (see FIG. 2). Consequently, with this porting, drive piston 64 and boost piston 66 are always coupled to the intensifier chamber 22, and accordingly, always subjected to the pressure created by the intensifier. The orifice member 70 is optional and may or may not be used.

Referring now to FIG. 3, at another position about the axis of the injector is a port 74, which together with ports 76 and 78 couple region 80 under valve member 82 with region 84 under boost piston 66 and drive piston 64.

Figure 5:
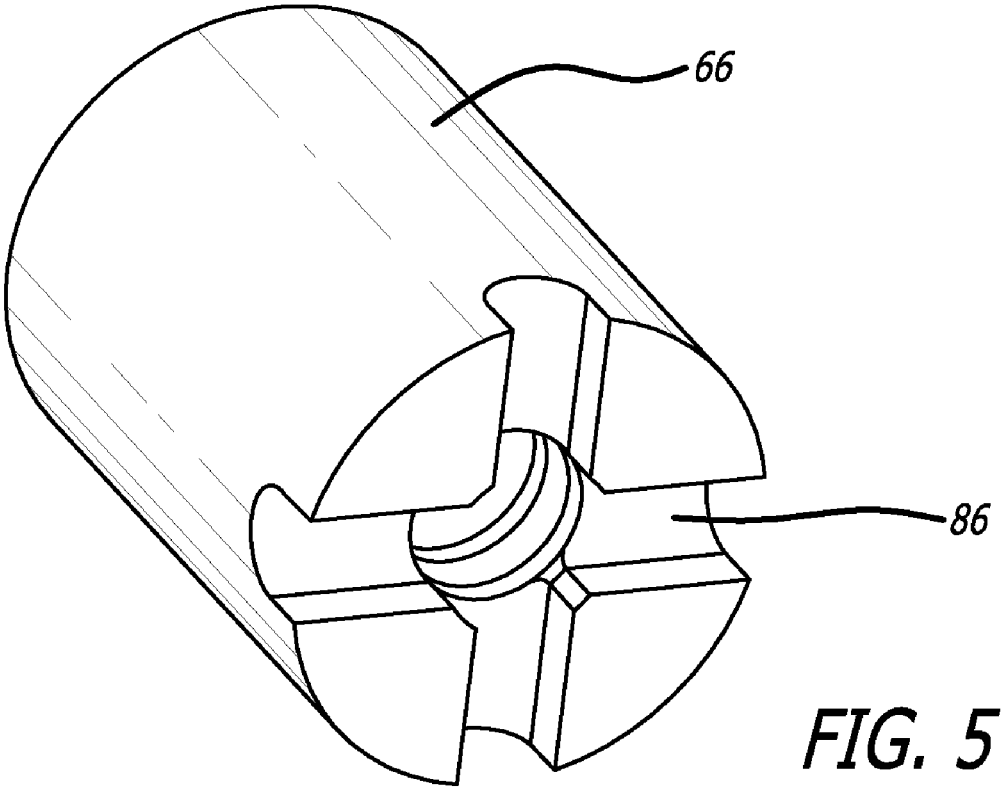
FIG. 5 is a perspective view of the boost piston 66.

A perspective view of boost piston 66 may be seen in FIG. 5. As shown therein, the bottom is slotted with slots 86 so that pressure communicated to chamber 84 also acts on the bottom of boost piston 66 as well as on the drive piston 64.

Figure 6:
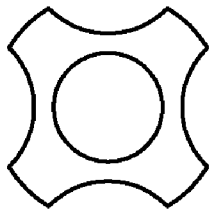
FIG. 6 is an end view of valve member 50.

Valve member 50 is controlled by the lower drive pin 54, and when held in the lower position shown in FIGS. 3 and 4, blocks fluid communication between ports 74, 76 and 78 (FIG. 3) and port 72 (FIG. 4) in communication with the intensifier chamber 22. The periphery of valve member 50 is non-circular as shown in FIG. 6, thereby when in the lower position allowing flow (depressurization) from below the boost and drive pistons 66 and 64 through ports 76, 74 and 78 upward to region 86, which is vented to a low pressure drain. When valve member 48 (FIG. 2) is allowed to move upward, the high pressure in intensifier chamber 22 (FIG. 4) will be coupled to the region below valve member 50, thereby forcing the valve member 50, lower drive pin 54, upper drive pin 52 and valve member 48 upward, so that valve member 50 now seals the passage thereabove, thereby coupling the intensified fuel pressure from chamber 22 through passages 56, 58 and 68 (FIG. 4) to passages 78, 74, 76 and region 84 (FIG. 3) to provide intensified fuel pressure under boost piston 66 and drive piston 64.

Having now described the various elements of an exemplary injector in accordance with the present invention, the operation thereof will now be described.

The injector is shown in FIGS. 1 through 4 in a state awaiting an injection event. In this state, the needle is closed, the pressure in the intensifier chamber 22 is the pressure of the fuel source, which pressure is also exerted on drive pin 64 and boost piston 66, with the region under the drive pin 64 and boost piston 66 being vented through three-way valve 50 to drain. The needle is held closed primarily by the needle return spring 42. As an injection event approaches, one or both of control valves 28 and 30 is actuated to pressurize the respective intensifier pistons 24 and 26 by actuation fluid under pressure, such as engine oil or fuel. The resulting intensified fuel pressure in intensifier chamber 22 is communicated both to the needle chamber around needle 38 and over drive piston 64 and boost piston 66. The area over drive piston 64 is purposely made larger than the area of the seat of the needle, and accordingly will hold the needle in the closed position in spite of the intensified fuel pressure around the needle. The intensified fuel pressure over the top of boost piston 66 holds the boost piston down against member 90, with the top 92 of needle drive pin 40 being slightly below the bottom of boost piston 66. During this time valve member 50 is held downward by pin 54 against the pressure of the intensified fuel by the area of piston 48 and the pressure of the actuating fluid thereabove, in the preferred embodiment pressurized engine oil, though pressurized fuel or other fluid could be used for this purpose also.

When actual injection is to commence, control valve 44 is actuated to couple the top of piston 48 to a vent or drain, allowing the intensified fuel pressure to force valve member 50 and valve drive member 54 and piston 48 upward, so that now valve member 50 seals the vent to chamber 86 and instead couples intensified fuel pressure to chamber 84 under drive piston 64 and boost piston 66. While there will still be a net hydraulic force downward on the top 92 of needle drive pin 40 (the region around needle return spring 42 being vented) equal to the intensified fuel pressure times the area of the top 92 of the drive pin 40, the area of the top 92 of the drive pin is purposely made less than the area of the needle region 94 minus the area of the needle seat so that the upward force on the needle by the intensified fuel in the needle chamber will provide a net needle opening force to initiate injection.

To stop injection, valve 44 is de-energized (unlatched if a latching actuator is used in the control valves), thereby pressurizing the area over piston 48 with pressurized actuation fluid, forcing upper and lower drive pins 52 and 54 downward to force valve 50 back to the original position shown in FIGS. 1 through 4. As previously stated, this vents region 84 under drive piston 64 and boost piston 66 so that the intensified fuel pressure thereover may drive both pistons downward. In that regard, during injection when the needle is in the open position, region 92 will rise above the level of the top of member 90, forcing both the drive piston 64 and boost piston 66 upward. Thus when region 84 is first vented, the intensified fuel pressure over the drive piston 64 and boost piston 66 will force drive pin 40 rapidly downward toward the needle closed position. However before the needle reaches the needle closed position, boost piston 66 will contact the top of member 90, thereby stopping before the needle fully closes, with drive piston 64 continuing to force the needle to the closed position during the final part of the needle motion. In that regard, in the preferred embodiment, the area of the top of the boost piston 66 is approximately twice the area of the top of drive piston 64 so that the closing force on the needle will drop by 50% just before the needle impacts the needle seat. Also, of course, the cross-sectional area of the top of drive pin 64 itself is chosen to be larger than the area of the needle region 94 minus the area of the needle seat so that the drive pin 64 alone will hold the needle in the closed position against the intensified fuel pressure in the needle chamber around the needle. Now when the intensifier pistons 24 and 26 are coupled to a vent, the intensified fuel pressure will drop, decreasing the net closing force on the needle until normally the dominant closing force is from the needle return spring. However note that long before the needle closing spring 42 is able to close the needle, needle closure is accomplished in a rapid manner by venting the region under drive piston 64 and boost piston 66, providing a large hydraulic closing force on the needle to initiate needle closing motion and stepping that closing force down before the needle actually impacts the needle seat.

While the foregoing description suggests that operation of the control valve 44 to vent the area under the boost and drive pistons 66 and 64 precedes the operation of the control valve venting the intensifier pistons to end intensification, their operation may be substantially or actually simultaneous if desired. This is because the compression of intensified fuel as well as the compression of the actuation fluid for the intensifier will cause the intensified fuel pressure to drop much slower than the intensified fuel pressure under the boost and drive pistons 66 and 64 when vented, whereby the needle will be forcibly closed before the intensified fuel pressure in the needle chamber around the needle has a chance to drop that much.

Thus unlike the prior art, where hydraulic pressure over the needle is controlled to control needle motion, in the present invention hydraulic pressure effectively under the needle controls the needle motion, and in addition, provides a high force for fast needle motion without imparting that high force to the needle seat on impact of the needle with the needle seat.

In the preferred embodiment the needle motion is approximately 0.010 inches, with the boost piston 66 being active throughout approximately 0.008 inches from the needle open position, being deactivated in the final 0.002 inches of needle closure. Accordingly, the top 92 of needle drive pin 40 will be below the top surface of member 90 when in the needle closed position by approximately 0.002 inches (see FIGS. 3 and 4).

The electrically operated control valves 28, 30 and 44 may be, by way of example, single coil, spring return valves, magnetically latching or not, or double coil valves, as are well known in the art. The actuation fluid for the hydraulic return of the second stages may be engine oil, fuel or other suitable fluid, or alternatively some other return method could be used, such as a spring return. Similarly, the intensifier and the control valve 48 may use an actuation fluid of engine oil, fuel or other suitable fluid as desired. Similarly, spool valves are preferred, though the invention is not so limited.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A method of operating an intensifier type fuel injector with direct needle control comprising:

providing a boost piston and a drive piston, each disposed to controllably force a needle toward a needle closed position in response to hydraulic forces thereon, the boost piston including a stop to stop the motion of the boost piston before the needle reaches the closed position;

when the needle is to be closed, unbalancing the hydraulic forces on the boost piston and drive piston to controllably force the needle toward the needle closed position, the area of the drive piston being adequate to maintain the needle closed against a needle opening force of fuel at an intensified pressure around the needle;

when the needle is to be opened for fuel injection, equalizing the hydraulic forces of the boost and drive pistons to allow the needle to open.

2. The method of claim 1 further comprising encouraging the needle toward the closed position by a spring.

3. The method of claim 2 wherein the boost and drive pistons are actuated by fuel at an intensified pressure using an intensifier.

4. The method of claim 3 wherein fuel in fluid communication with the intensifier is coupled to first areas of the boost and drive pistons to encourage the needle toward the closed position, and when the needle is to open, fuel in fluid communication with the intensifier is also coupled to second areas of the boost and drive pistons opposite the first areas.

5. The method of claim 4 wherein the coupling of fuel in fluid communication with the intensifier to the second areas of the boost and drive pistons is controlled by a first hydraulically actuated valve.

6. The method of claim 5 wherein the first hydraulically actuated valve is controlled by an electrically controlled spool valve.

7. The method of claim 4 wherein the hydraulic force on the needle due to fuel pressure around the needle tending to open the needle is less than the hydraulic force of the first area of the drive piston tending to hold the needle closed, and greater than the hydraulic forces on the first and second areas of the boost and drive pistons when the first and second areas are subjected to intensified fuel pressure.

* * * * *